US005970932A

United States Patent [19]

Richardson et al.

[11] Patent Number: 5,970,932

[45] Date of Patent: Oct. 26, 1999

[54] ROCKER ARM ASSEMBLY

[75] Inventors: Darwin Arthur Richardson; Robert Henry Ellard, both of Canon City, Colo.

[73] Assignee: Panzer

[21] Appl. No.: 08/982,610

[22] Filed: Dec. 2, 1997

[51] Int. Cl.[6] ..... F01M 9/10; F01L 1/18

[52] U.S. Cl. ..... 123/90.36; 123/90.41

[58] Field of Search ..... 123/90.39, 90.41, 123/90.44, 90.45, 90.36, 90.61

[56] References Cited

U.S. PATENT DOCUMENTS

| | | | |
|---|---|---|---|
| 4,655,177 | 4/1987 | Wells et al. | 123/90.36 |
| 4,718,379 | 1/1988 | Clark | 123/90.39 |
| 4,741,553 | 5/1988 | Raidel, II | 280/682 |
| 4,896,635 | 1/1990 | Willermet et al. | 123/90.39 |
| 5,018,487 | 5/1991 | Shinkai | 123/90.16 |
| 5,031,584 | 7/1991 | Frost | 123/90.39 |
| 5,095,861 | 3/1992 | Dove, Jr. | 123/90.39 |
| 5,123,384 | 6/1992 | Abbas | 123/90.39 |
| 5,285,756 | 2/1994 | Squires | 123/294 |
| 5,442,914 | 8/1995 | Otsuka | 60/527 |
| 5,647,319 | 7/1997 | Uehara et al. | 123/322 |
| 5,655,499 | 8/1997 | Uehara et al. | 123/321 |

OTHER PUBLICATIONS

Harley Davidson Specification Drawing for a panhead engine, p. 2.

Harley Davidson Specification Drawing for Rocker Arms, Cover and Pushrod Assembly, p. 8.

*Primary Examiner*—Weilun Lo

*Attorney, Agent, or Firm*—Dale B. Halling

[57] ABSTRACT

A panhead style rocker arm assembly (10) has a rocker arm (30) with a solid cylindrical section (32). A pushrod lever (34) extends perpendicular to a longitudinal axis of the solid cylindrical section (32) and is attached to a first end (36) of the solid cylindrical section (32). A valve lever (38) extends from a second end (40) of the solid cylindrical section (32). A bushing (26, 28, 44, 46) matingly fits around the solid cylindrical section (32). A pair of guides (12, 42) fit over the bushing (26, 28, 44, 46) and attach to a cylinder head.

14 Claims, 1 Drawing Sheet

ROCKER ARM ASSEMBLY

FIELD OF THE INVENTION

The present invention relates generally to the field of engines and more particularly to a rocker arm assembly.

BACKGROUND OF THE INVENTION

There has been a nostalgic resurgence in owning and riding the panhead style engine motorcycles. Anyone wishing to rebuild a panhead style engine will find that the rocker arm assembly was never designed to be rebuilt. In addition, all replacement rocker arm assemblies have a brass upper guide. The original rocker arm assemblies had a bronze upper guide. Unfortunately, the new brass upper guides do not last very long before they need to be replaced. In addition, the original panhead style rocker arm assemblies leaked oil and were known to be noisy. This resulted from the inability to adjust the rocker arm end play tolerance. Since the rocker arm assembly is at the end of the oil lubricating system for the engine, the leaky nature of the rocker arm assembly resulted in poor oil pressure. The poor oil pressure means that other components receiving oil did not necessarily receive proper lubrication, thus reducing the life of these components.

Thus there exists a need for an improved panhead style rocker arm assembly that overcomes these and other problems.

SUMMARY OF THE INVENTION

A panhead style rocker arm assembly that overcomes these and other problems has a rocker arm with a solid cylindrical section. A pushrod lever extends perpendicular to a longitudinal axis of the solid cylindrical section and is attached to a first end of the solid cylindrical section. A valve lever extends from a second end of the solid cylindrical section. A bushing matingly fits around the solid cylindrical section. A pair of guides fit over the bushing and attach to a cylinder head.

DETAILED DESCRIPTION OF THE DRAWINGS

Figure 1:
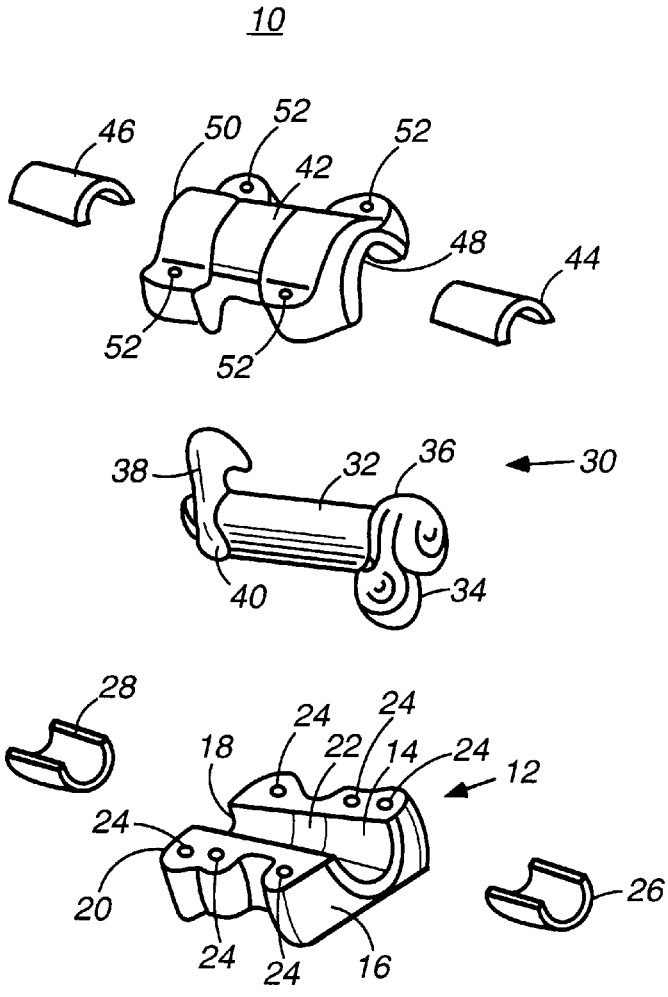
FIG. 1 is an exploded view of a rocker arm assembly in accordance with one embodiment of the invention.

FIG. 1 is an exploded view of a rocker arm assembly 10 in accordance with one embodiment of the invention. The panhead rocker arm assembly 10 has a first guide 12 designed to be attached to a cylinder head of an engine. The first guide (bottom guide) 12 has a first bushing slot (first U-shaped void) 14 extending from a first edge 16 of the bottom guide 12. A second bushing slot (second U-shaped void) 18 is coaxial with the first bushing slot 14. The second bushing slot 18 extends from a second edge 20. An oil guide 22 connects the first bushing slot 14 to the second bushing slot 18. In one embodiment the oil guide 22 has a first diameter that is smaller than a second diameter of the first bushing slot 14 or a third diameter of the second bushing slot 18. In one embodiment, the second and the third diameter are equal. The bottom guide 12 has a plurality of attachment means (plurality of attachment provisions) 24. In one embodiment bolt studs extend up from the cylinder head and the bottom guide slides over the bolt studs. In another embodiment, a bolt extends down through the attachment provisions and threads into the a female threaded hole in the cylinder block. In one embodiment, the bottom guide is made of aluminum.

A first bushing segment 26 fits inside the first bushing slot 14. The second bushing segment 28 fits inside the second bushing slot 18. In one embodiment the first bushing segment 26 and the second bushing segment 28 are made of an oil impregnated bronze. In another embodiment the first and second bushing segment 26, 28 are made of brass. However, the brass bushing segments will wear out faster than the bronze bushings. The first bushing segment 26 has a diametrical width that is greater than the difference between the second diameter of the first bushing slot 14 and the first diameter of the oil guide 22. As a result the first bushing segment, forms a wall of the oil guide 22. Note that the first and second bushing 26, 28 rotate freely inside the first guide 12.

A rocker arm (panhead style rocker arm) 30 has a solid cylindrical section (cylindrical section) 32 that is connected to a pushrod lever 34 at a first end 36 of the cylindrical section 32. The pushrod lever 34 extends perpendicular to a longitudinal axis of the solid cylindrical section 32. A valve lever 38 is connected to a second end 40 of the cylindrical section 32. The pushrod lever engages a pushrod and the valve lever engages a valve rod. The cylindrical section 32 fits over the first bushing segment 26 and the second bushing segment 28. The cylindrical section 32 slides freely over the bushing segments 26, 28.

Functionally a top guide (second guide) 42 and a third bushing segment 44 and a fourth bushing segment 46 are the same as their lower counterparts. The top guide 42 has a third bushing slot 48, a fourth bushing slot 50 and an oil guide connecting the third and fourth bushing slots 48, 50. The third bushing segment 44 fits inside the third bushing slot 48 and the fourth bushing segment 46 fits inside the fourth bushing slot 50. The top guide 42 with the third and fourth bushings 44, 46 then fits over the cylindrical section 32 of the rocker arm 30. The top guide 42 has a plurality of attachment provisions 52 that align to the attachment provisions 24 of the bottom guide 12. In one embodiment the third and fourth bushing segments 44, 46 are made of oil impregnated bronze. The plurality of bushing sections 26, 28, 44, 46 form the bushing. The ends of the bushings 26, 28, 44, 46 can be filed to adjust the rocker arm end play tolerance. By properly adjusting the end play tolerance the rocker arm assembly runs quietly. The oil guide in the bottom and upper guides 12, 42 allows the oil to spread freely to all the bushings, guides and rocker arm. Because the oil guide does not allow the oil to just leak out of the edges of the rocker arm assembly, the oil pressure and lubrication of the whole engine are improved. This reduces the wear on other components of the engine, reduces the friction throughout the engine and increases the horse power of the engine. When the guides are made of aluminum they are lighter weight than the prior art rocker arm assemblies and less expensive to manufacture. The aluminum also provides better heat dissipation than the prior art designs.

Figure 2:
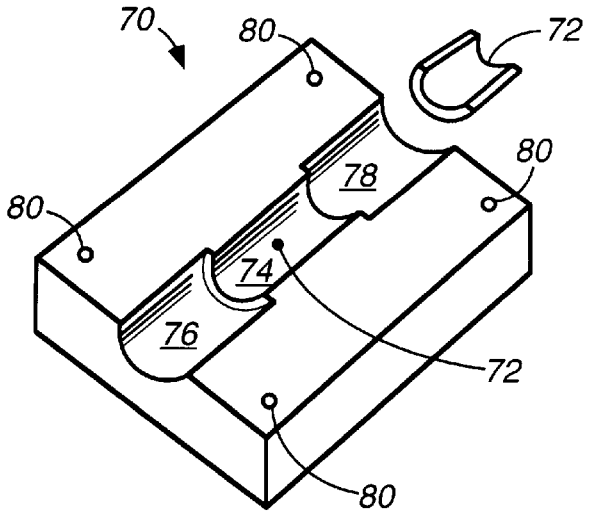
FIG. 2 is a perspective view of a guide and a bushing segment in accordance with one embodiment of the invention.

FIG. 2 is a perspective view of a guide 70 and a bushing segment 72 in accordance with one embodiment of the invention. In this embodiment, the guides 70 are almost identical, except the bottom guide has oil orifice in the oil guide 74. The guide 70 is a rectangular block with a first guide slot 76 and a second guide slot 78 connected together by the oil guide 74. In one embodiment the guide 70 is made of aluminum and has a plurality of attachment holes 80. The bushing segments 72 fit inside the guide slots 76, 78. The rocker arm assembly is produced by forming a pair of aluminum rectangular blocks. The pair of aluminum rectangular blocks are aligned on top of each other. A plurality of attachment provisions (plurality of mounting holes) 80 are drilled through the rectangular blocks. Then a first slot having a first diameter is drilled through the center of the first and second blocks. The first diameter defines the size of the oil guide (passgeway) 74. Then a first bushing slot 76 is bored having a second diameter. The first bushing slot 76 is coaxial with the first slot and extends less than halfway into the blocks. Next a second bushing slot 78 is bored having a third diameter. The second bushing slot 78 is coaxial with the first slot and extends less than halfway into the blocks. In one embodiment, the second diameter is equal to the third diameter. The first, second, third and fourth bushing segments are then inserted into the bushing slots 76, 78 of both the first and second guides. Next, a panhead style rocker arm is placed between the guides. The proper end play tolerance can then be determined. If the rocker arm does not have the proper end play tolerance, the bushing segments can be filed to establish the proper end play tolerance.

In another embodiment, a pair of old guides can be bored as explained above and then the bushing added. This will also work with the replacement brass upper guides. This rocker assembly can be easily rebuilt because the bronze bushing segments take all the wear. As result the rocker arm assemblies can be rebuilt by installing new bushing assemblies. In addition, the invention will significantly increase the useful life of the brass upper guide.

Thus there has been described a rocker assembly and a method of manufacture that overcomes the problems of the prior art. While the invention has been described in conjunction with specific embodiments thereof, it is evident that many alterations, modifications, and variations will be apparent to those skilled in the art in light of the foregoing description. Accordingly, it is intended to embrace all such alterations, modifications, and variations in the appended claims.

What is claimed is:

1. A panhead style rocker arm assembly comprising:

a rocker arm having a solid cylindrical section having a pushrod lever extending perpendicular to a longitudinal axis of the solid cylindrical section and attached to a first end of the solid cylindrical section and having a valve lever extending from a second end of the solid cylindrical section;

a bushing matingly fitted around the solid cylindrical section to provide a proper end play tolerance; and a pair of guides fitting over the bushing and having an attachment means for attaching the pair of guides to a cylinder head.

2. The panhead style rocker arm assembly of claim 1, wherein the bushing is made of an oil impregnated bronze.

3. The panhead style rocker arm assembly of claim 1, wherein the bushing is formed of a plurality of bushing sections.

4. The panhead style rocker arm assembly of claim 1, wherein the pair of guides are made of aluminum.

5. The panhead style rocker arm assembly of claim 1 wherein the pair of guides includes a bottom guide having a relatively flat base, a first U-shaped void extending from a first edge, a second U-shaped void extending from a second edge opposite the first edge and an oil guide connecting the first U-shaped void to the second U-shaped void.

6. The panhead style rocker arm assembly of claim 5, wherein the pair of guides includes a top guide having a first U-shaped void extending from a first edge, a second U-shaped void extending from a second edge opposite the first edge and an oil guide connecting the first U-shaped void to the second U-shaped void.

7. The panhead style rocker arm assembly of claim 1, wherein the solid cylindrical section rotates freely inside the bushing.

8. A rocker arm assembly, comprising:

a first guide designed to attached to a cylinder head, the first guide having a first bushing slot, a second bushing slot coaxial with the first bushing slot and an oil guide connecting the first bushing slot with the second busing slots;

a first bushing segment fitting in the first bushing slot;

a second bushing segment fitting in the second bushing slot;

a rocker arm having a cylindrical segment and a pushrod lever at a first end of the cylindrical segment and a valve lever at a second end of the cylindrical segment, the cylindrical segment fitting over the first bushing segment and the second bushing segment;

a third bushing segment fitting against the cylindrical segment opposite the first bushing segment;

a fourth bushing segment fitting against the cylindrical segment opposite the second bushing segment; and a second guide fitting over the first guide, the third bushing segment and the fourth bushing segment.

9. The rocker arm assembly of claim 8, wherein the first bushing segment is made of an oil impregnated bronze.

10. The rocker arm assembly of claim 8, wherein the first guide is made of aluminum.

11. The rocker arm assembly of claim 8, wherein the first guide is a rectangular block with the first bushing slot, the second bushing slot and the oil guide machined from the rectangular block and having a plurality of mounting holes.

12. The rocker arm assembly of claim 8, wherein the second guide is made of aluminum.

13. The rocker arm assembly of claim 8, wherein the first guide further includes an oil orifice in the oil guide.

14. The rocker arm assembly of claim 8, wherein the oil guide is a passageway formed between the cylindrical segment and the first guide and between the first bushing segment and the second bushing segment.

* * * * *